US007773895B2

(12) United States Patent
Zaima

(10) Patent No.: US 7,773,895 B2
(45) Date of Patent: Aug. 10, 2010

(54) IMAGE FORMING APPARATUS AND CONTROL METHOD OF THE SAME

(75) Inventor: Nobuhiko Zaima, Abiko (JP)

(73) Assignee: Canon Kabushiki Kaisha (JP)

( * ) Notice: Subject to any disclaimer, the term of this patent is extended or adjusted under 35 U.S.C. 154(b) by 630 days.

(21) Appl. No.: 11/679,314

(22) Filed: Feb. 27, 2007

(65) Prior Publication Data

US 2007/0230978 A1 Oct. 4, 2007

(30) Foreign Application Priority Data

Mar. 31, 2006 (JP) ..... 2006-098771

(51) Int. Cl.
*G03G 15/00* (2006.01)

(52) U.S. Cl. ..... 399/49

(58) Field of Classification Search ..... 399/45, 399/49

See application file for complete search history.

(56) References Cited

U.S. PATENT DOCUMENTS

2004/0081477 A1* 4/2004 Maebashi et al. ..... 399/49
2005/0147426 A1* 7/2005 Suzuki et al. ..... 399/49

FOREIGN PATENT DOCUMENTS

| | | | |
|---|---|---|---|
| JP | 62-296669 | A | 12/1987 |
| JP | 01-309082 | A | 12/1989 |
| JP | 10-193689 | A | 7/1998 |
| JP | 2003-032461 | A | 1/2003 |

* cited by examiner

*Primary Examiner*—David M Gray
*Assistant Examiner*—Erika Villaluna
(74) *Attorney, Agent, or Firm*—Rossi, Kimms & McDowell LLP

(57) ABSTRACT

An image forming apparatus capable of detecting the density of an image patter with a sufficient accuracy irrespective of the color and/or the density of the image pattern, making it possible to carry out color stabilizing control of an output image with high accuracy. An image pattern formed on a transfer material is read by an optical sensor, and based on information on the image pattern, image forming conditions are controlled by a controller. In accordance with the color and the density of the image pattern, an accumulation time of the optical sensor is set.

7 Claims, 9 Drawing Sheets

LED CHROMATICITY RANGE

| | | | | |
|---|---|---|---|---|
| X | 0.296 | 0.286 | 0.330 | 0.330 |
| Y | 0.276 | 0.305 | 0.360 | 0.318 |

IMAGE FORMING APPARATUS AND CONTROL METHOD OF THE SAME

BACKGROUND OF THE INVENTION

1. Field of the Invention

This invention relates to an image forming apparatus for performing image formation using an electrophotographic technique, an inkjet technique or the like, and relates to a control method of the image forming apparatus.

2. Description of the Related Art

To ensure color stability of an output image from an image forming apparatus, various techniques for color stabilizing control have conventionally been proposed. These techniques are designed to read a pattern of a toner patch image formed, for example, on a surface of a photosensitive member in an electrophotographic printer using a density sensor from which the read information is fed back to a toner density controller of a developing unit, which carries out control to produce the appropriate toner density (see for example Japanese Laid-Open Patent Publication (Kokai) No. H01-309082).

The toner patch image is generally easily formed and removed. However, the toner density information can be obtained only before the toner image is fixed on a sheet, and therefore, the toner density control based on such toner density information cannot reflect influences occurring during and after the fixing process.

To obviate this, a method has been proposed in which an image is formed on an output sheet by, for example, a printer unit of a copying machine, the image is read by a reader unit attached to the printer unit, and image control is performed based on the result of read image (see Japanese Laid-Open Patent Publication (Kokai) No. S62-296669, for example). With this method, a user is required to perform complicated operations such as picking up an output sheet formed with an image from a sheet discharge unit of the copying machine, feeding the output sheet to the reader unit, and setting the reader unit to be ready for image reading.

To eliminate the complexity of operations, there has been disclosed a technique of detecting an output image formed on a sheet using a sensor disposed along a conveying path on the side downstream of a fixing device for fixing a toner image on the sheet (see Japanese Laid-Open Patent Publications (Kokai) No. H10-193689, for example).

Also in the field of inkjet printer, there is a problem that print color can vary due to variation in ink discharge amount with the passage of time, differences in environment, individual differences between ink cartridges, and the like. To eliminate this problem, there has been put on the market an inkjet printer that uses a density sensor disposed next to an ink head to accurately grasp and control the color stability of printed ink on a sheet.

Irrespective of whether the printer is based on the electrophotographic technique or the inkjet technique, the most important issue is to maintain the color stability. Also important is to commercialize products designed in consideration not only of technical improvements but also of users' operability. Thus, much attention is focused on the color stabilizing control of an output image using the sensor disposed along the conveying path on the side downstream of the fixing device.

However, the color stabilizing control on an output image using the sensor disposed downstream of the fixing device as in the prior art entails a problem that the color stabilizing control cannot be carried out with sufficient accuracy since the accuracy of detecting the density of a test pattern can be lowered due to variations in sensor characteristics and the like.

As the sensor disposed downstream of the fixing device, an optical color sensor is mainly used that includes a light emitting element, a light receiving element, and a color filter. The detection accuracy of this sensor can be lowered due to, for example, variations in characteristics of these components. For instance, when test patterns of the same density are detected at the same light source intensity, an output value for a yellow test-pattern image obtained through a blue filter is smaller than those of magenta and cyan test-pattern images respectively obtained through green and red filters. In other words, an S/N ratio is low in the detection of the yellow test-pattern image. Similar phenomenon can be caused due to variations in spectral characteristic of the light emitting/receiving element and can be also caused depending on the density of image pattern to be detected.

To improve the S/N ratio, a method for adjusting light emission intensity has been proposed. However, this method has drawbacks that the light intensity can vary due to heat generation caused when electric current is increased to increase the light intensity and that the output voltage from the light receiving element can saturate when a change occurs in conditions. Heretofore, an adequate countermeasure therefor has not been taken.

SUMMARY OF THE INVENTION

An object of the present invention is to provide an image forming apparatus and a control method thereof that are capable of detecting the density of an image patter with a sufficient accuracy irrespective of the color and/or the density of the image pattern, making it possible to carry out color stabilizing control of an output image with high accuracy.

To attain the above object, according to a first aspect of the present invention, there is provided an image forming apparatus comprising a control device configured to read a predetermined image pattern formed on an image forming medium using an optical sensor and configured to control image forming conditions based on information on the predetermined image pattern thus read, and a setting device configured to set an accumulation time of the optical sensor in accordance with at least one of a color and a density of the predetermined image pattern.

To attain the above object, according to a second aspect of the present invention, there is provided a control method of an image forming apparatus, comprising a reading step of reading a predetermined image pattern formed on an image forming medium using an optical sensor, a controlling step of controlling image forming conditions based on information on the predetermined image pattern having been read in the reading step, and a setting step of setting an accumulation time of the optical sensor in accordance with at least one of a color and a density of the predetermined image pattern.

According to the present invention, the density of an image pattern can be detected with a sufficient accuracy irrespective of the color and/or the density of the image pattern, making it possible to carry out the color stabilizing control of output image with high accuracy.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

First Embodiment

[Construction of Image Forming Apparatus]

Figure 1:
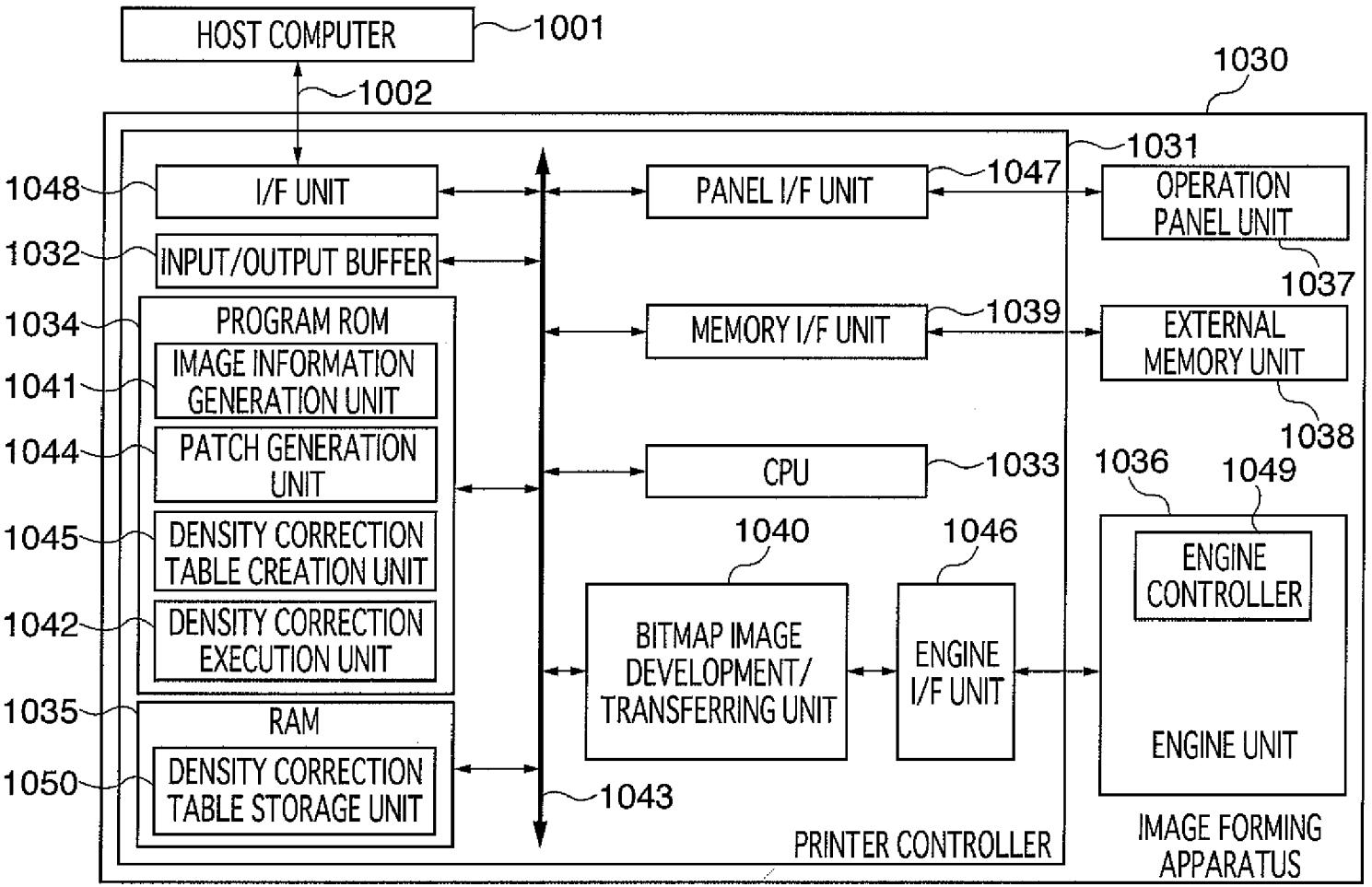
FIG. 1 is a block diagram showing the construction of essential part of an image forming apparatus according to a first embodiment of the present invention.

FIG. 1 is a block diagram showing the construction of essential part of an image forming apparatus according to a first embodiment of the present invention.

In FIG. 1, an image forming apparatus 1030 is designed as a color laser beam printer (copying machine) for image formation utilizing, for example, an electrophotographic technique. The image forming apparatus 1030 includes a printer controller 1031 for controlling the entire image forming apparatus, an image forming apparatus engine unit (hereinafter referred to as engine unit) 1036 for controlling image forming operations, an operation panel unit 1037, and an external memory unit 1038. The image forming apparatus 1030 is connected with a host computer 1001 via a communication line 1002.

The printer controller 1031 includes a system bus 1043 to which are connected various function modules including a host interface (hereinafter referred to as I/F) unit 1048, an input/output buffer 1032, a program ROM 1034, a RAM 1035, a panel I/F unit 1047, a memory I/F unit 1039, a CPU 1033, a bitmap image development/transferring unit 1040, and an engine I/F unit 1046.

The CPU 1033 controls the entire printer controller 1031, performs a color stabilizing control on output image as mentioned later, and executes the process shown in the flowchart of FIG. 6 based on control program.

The program ROM 1034 stores a control program executed in and control data utilized in the CPU 1033 and program modules (corresponding to an image information generation unit 1041, a patch generation unit 1044, a density correction table creation unit 1045, and a density correction execution unit 1042). The patch generation unit 1044 generates a toner patch image used for measurement of a toner density which is in turn used for toner density correction. The density correction table creation unit 1045 creates a density correction table based on results of the toner density measurement. The density correction execution unit 1042 executes the toner density correction.

The RAM 1035 is used as a work memory for performing calculation processing to analyze and/or print the control codes and/or data received from the host computer 1001, or for performing print data processing. In addition to the work memory, the RAM 1035 has a density correction table storage unit 1050 that stores the density correction table created by the density correction table creation unit 1045.

The engine unit 1036 is for actually forming an image on a transfer material, and includes an engine controller 1049 for controlling the engine unit 1036. The operation panel unit 1037 has an operation unit for giving instructions such as an instruction for setting the number of print copies/print magnification at the time of performing printing by the image forming apparatus and an instruction for start of printing. The operation panel unit 1037 also has a display unit for displaying setting information and the like. The external memory unit 1038 is used for storing print data and various information on the image forming apparatus.

Figure 2:
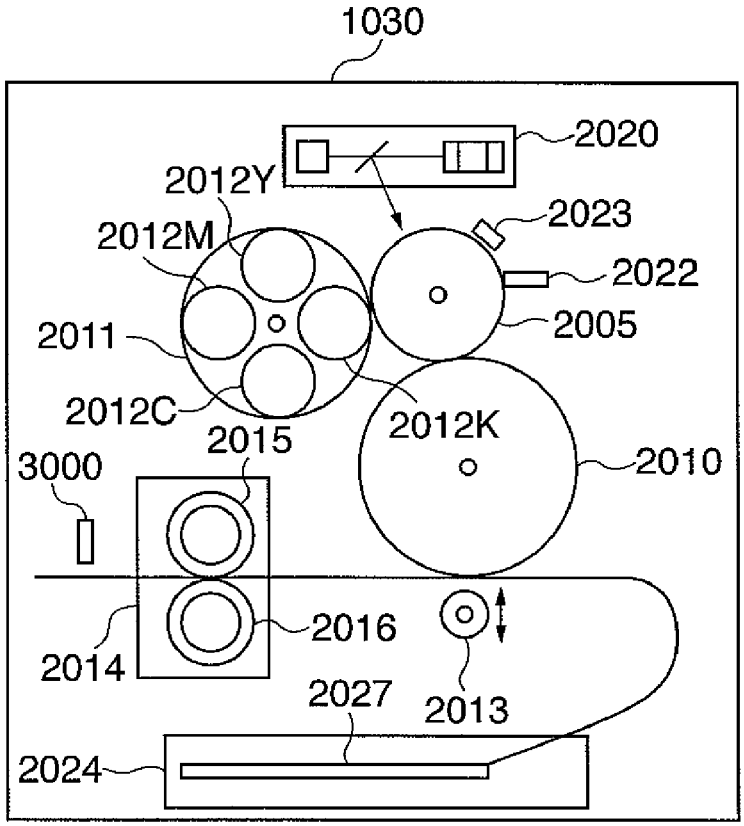
FIG. 2 is a view showing the internal construction of the image forming apparatus.

FIG. 2 is a diagram showing the internal structure of the image forming apparatus 1030.

The engine unit 1036 is provided with an optical processing device, a fixing device, a sheet feeding device, and a conveyance device, which will be outlined below.

In the optical processing device, a laser scanner 2020 scans a laser beam in accordance with image data supplied from the printer controller 1031 to thereby form an electrostatic latent image on a photosensitive member (photosensitive drum) 2005 charged with a primary charging device 2023. The electrostatic latent image formed on the photosensitive drum 2005 is visualized as a toner image by toners supplied from developing devices mentioned below. The visualized toner image on the photosensitive drum 2005 is transferred (primary transfer) onto the intermediate transfer member 2010, to which is applied a voltage having opposite polarity to that of the toner image.

For formation of a color image, development process is performed by a yellow developing device 2012Y, a magenta developing device 2012M, a cyan developing device 2012C, and a black developing device 2012K in the mentioned order while a developing rotary 2011 performs one rotation for each rotation of the intermediate transfer member 2010. During four rotations of the intermediate transfer member 2010, visible images in colors of yellow, magenta, cyan and black are formed in sequence, whereby a full color visible image is formed on the intermediate transfer member 2010. For formation of a monochrome image, development process is performed only by the black developing device 2012K, whereby a black visible image is formed during one rotation of the intermediate transfer member 2010.

The sheet feeding device feeds a transfer material (image forming medium) 2027 from a sheet feeding cassette 2024, and a transfer roller 2013 presses the transfer material 2027 to the intermediate transfer member 2010, while the transfer roller 2013 being applied with a bias voltage having opposite polarity to that of to the toner. As a result, a visible image on the intermediate transfer member 2010 is transferred to the transfer material 2027 (secondary transfer). While four toner images are formed on the intermediate transfer member 2010, i.e., while the intermediate transfer member 2010 rotates, the transfer roller 2013 is positioned on the lower side as shown by the solid line in FIG. 2 so as to be apart from the intermediate transfer member 2010, thereby preventing the toner images from being affected.

Remaining toner on the photosensitive drum 2005 is removed by a cleaner 2022. The fixing device includes a fixing device 2014 for fixing a toner image transferred on the transfer material 2027 by heat pressing. The fixing device 2014 includes a fixing roller 2015 for applying heat to the transfer material 2027 and a pressing roller 2016 for pressing the transfer material 2027 to the fixing roller 2015. The fixing roller 2015 and the pressing roller 2016 are hollow rollers each including a heater and adapted to transfer the transfer material 2027 when they are driven to rotate.

The conveyance device conveys the transfer material 2027. A color sensor 3000 for detecting a toner patch image formed on the transfer material is disposed along a conveying path on the side downstream of the fixing device 2014.

[Construction and Operation of Color Sensor 3000]

Figure 3A:
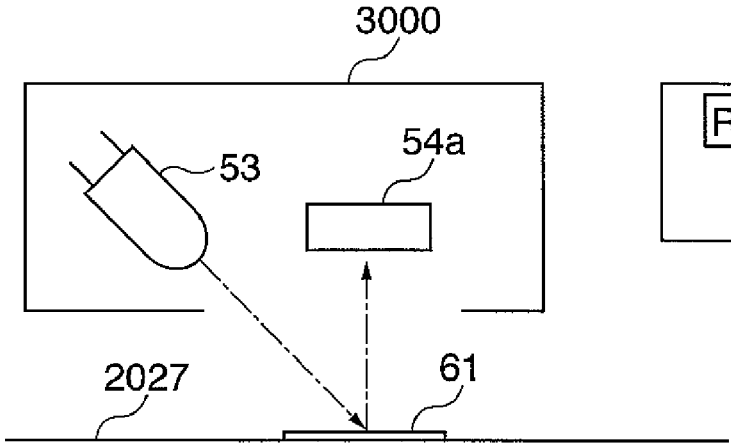
FIG. 3A is a view schematically showing an example of the construction of a color sensor.

FIG. 3A is a diagram showing an example of an arrangement of the color sensor 3000, and FIG. 4B is a diagram showing a photoreceptor of a light-receiving element of the color sensor 3000.

Figure 3B:
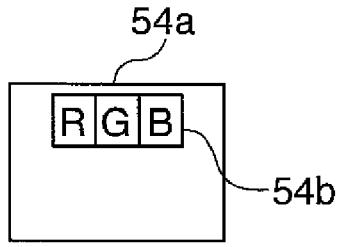
FIG. 3B is a view schematically showing an example of the construction of a photoreceptor of a light receiving element of the color sensor.

In FIGS. 3A and 3B, the color sensor 3000 is a sensor for reading a fixed toner patch image 61 formed on the transfer material 2027 and detecting RGB output values, where R, G and B represent red, green and blue. As shown in FIG. 3A, the color sensor 3000 includes a light emitting element 53 such as a white LED, a light-receiving element (a charge storage sensor with RGB on-chip filters) 54*a*, and a holder accommodating these elements.

Light emitted from the light emitting element (white LED) 53 enters the transfer material 2027, on which a fixed toner patch image 61 is formed, at an angle of 45 degrees with respect to the transfer material 2027, and diffuse reflection light intensity in the direction of 0 degree is detected by the light-receiving element 54*a*. As shown in FIG. 3B, the light-receiving element 54*a* is composed of photoreceptors 54*b* which are independent RGB pixels.

Figure 4:
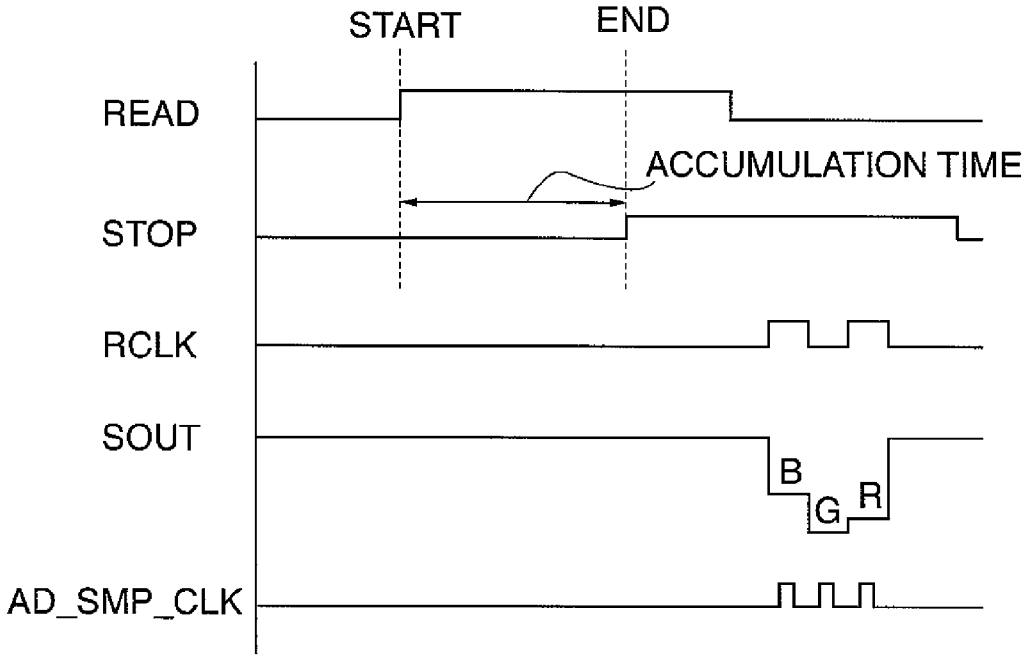
FIG. 4 is a timing chart showing read timing of the light receiving element.

Next, with reference to FIG. 4, an explanation will be given of a toner patch detecting operation of the color sensor 3000. FIG. 4 is a timing chart showing read timing of the light-receiving element 54*a* which is a charge storage sensor with RGB on-chip filters.

The color sensor 3000 is operated in accordance with signals from the engine controller 1049. At the time of image pattern measurement, as shown in FIG. 4, the LED 53 is lit in timing to a transfer material on which a predetermined image pattern has been formed being transferred. Then, charge storage is started in timing to the rise of a READ signal from the engine controller 1049 and completed in timing to the rise of a STOP signal.

The sensor 3000 outputs an SOUT signal (output signal), representative of readout results for respective pixels in timing to the rise and fall of an RCLK signal (readout clock) from the engine controller 1049. In an example shown in FIG. 4, the SOUT signal is output in the order of B (blue), G (green), and R (red). The engine controller 1049 samples the SOUT signal in timing to a AD_SMP_CLK signal (A/D conversion clock) to thereby perform analogue-to-digital conversion (10 bits), and outputs RGB digital signals representative of sensor detection results to the printer controller 1031.

In the engine controller 1049, the RGB signals are each normalized by a signal indicating the strength of reflection light from a transfer material and a predetermined output signal at the maximum density. The printer controller 1031 converts each of the digital signals into density information using a corresponding one of brightness/density conversion tables prepared beforehand for respective colors, and carries out color stabilizing control for output image based on the density information.

The signals from the engine controller 1049 including the READ signal and the STOP signal can be output at arbitrarily preset timings. Thus, the charge storage time of the light-receiving element 54*a* can be changed so as to be suited to an image pattern to be measured. The intensity of light emitted from the LED 53 can also be changed by the engine controller 1049 so as to be in conformity with the image pattern.

An optical sensor generates an output whose value varies depending on fabrication variations in its component elements and a minute shift in position relative to a measurement object, and generates a density-dependent output whose dynamic range varies depending on color filter characteristics of the sensor.

Figure 5:
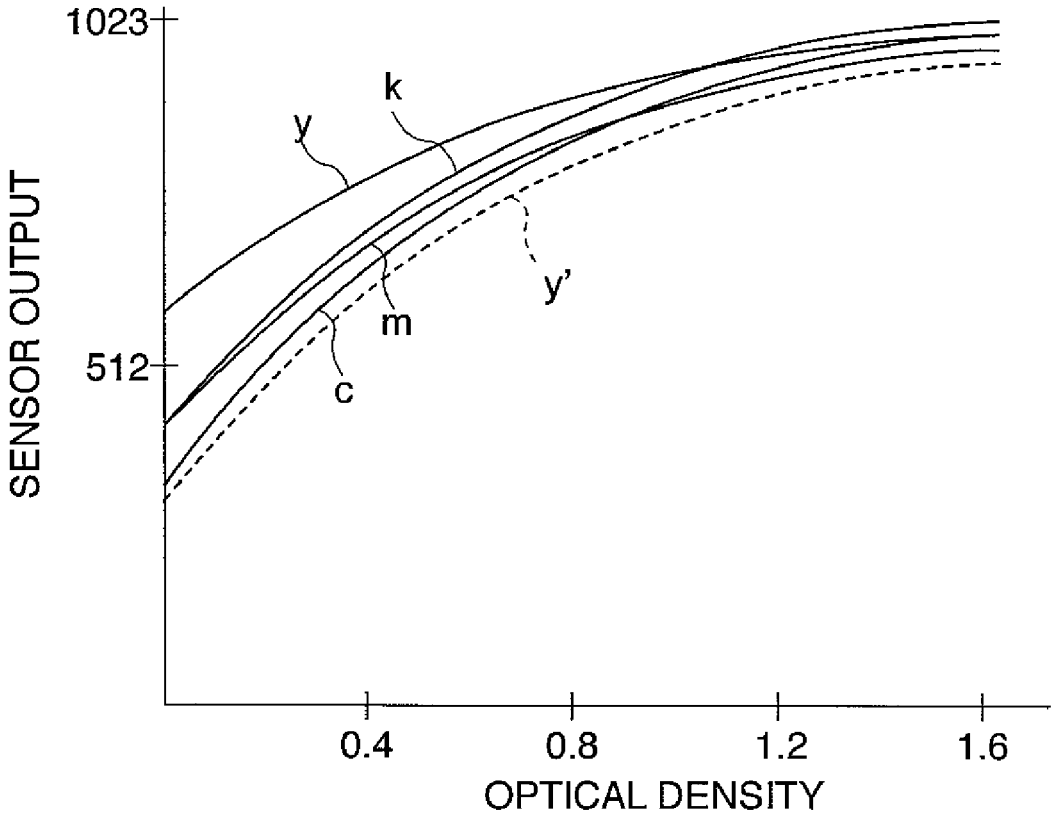
FIG. 5 is a graph showing a sensor output characteristic according to the first embodiment.

FIG. 5 is a graph showing a sensor output characteristic according to the first embodiment, in which a relationship between density of image pattern and sensor output is shown.

Curves y, m, c, and k in FIG. 5 represent a sensor output characteristic relative to the density of image patterns of respective colors (y: yellow, m: magenta, c: cyan, and k: black) at the same light intensity. When a light intensity adjustment is performed to correct or compensate for fabrication variations in component elements of an optical sensor and a difference in dynamic range of sensor output due to variation in color filter characteristic (hereinafter referred to as the filter difference), an adjustment range must be large, which causes a problem of variation in light intensity due to heat generation and a problem of increase in adjustment costs. To obviate this, in the present embodiment, the fabrication variation in the sensor 3000 is corrected by adjusting the light intensity of the LED 53, whereas the filter difference is corrected by adjusting the charge storage time of the light-receiving element 54*a*.

A curve y' in FIG. 5 represents an output characteristic obtained when the charge storage time for yellow is increased. With this, even when the sensor is constructed using a low-priced element, measurements for respective measurement colors can be carried out with an adequate dynamic range. As a result, the S/N ratio can be prevented from being lowered, thereby making it possible to measure the density with a satisfactory accuracy.

To adjust the LED light intensity so as to correct sensor variations, measurement is performed upon assembly of the image forming apparatus 1030 at a factory. In the measurement, a standard plate is measured using respective filters of the sensor, output values of the sensor for respective measurement colors are adjusted so that predetermined outputs for the respective colors may be obtained, and the adjusted output values are set in the engine controller 1049. At the measurement, the previously mentioned output signal at the maximum density that is used to normalize the sensor output is also set in the engine controller 1049. In consideration of typical sensor characteristic and toner characteristic, the charge storage times of the light-receiving element 54*a* for the respective colors, i.e., y (yellow), m (magenta), c (cyan) and k (black), are determined at a ratio of 1.5:1.1:1:1.1. After setting the charge storage times for the respective colors, the light intensity adjustment for the LED 53 is performed. At the time of control, the light intensity of the LED 53 and the charge storage time of the light-receiving element 54*a* is set in accordance with the measurement color.

It should be noted that in the present embodiment the light intensity of the LED 53 is set and the charge storage times of the light-receiving element 54*a* are fixedly set upon assembly of the image forming apparatus 1030. However, the way of setting the charge storage times is not limited thereto. The engine unit may be provided with a device for automatically setting the charge storage times.

Further, in the present embodiment both the light intensity and the charge storage times are made changeable to ensure that the image forming apparatus satisfactorily operates no matter how it is constructed. However, in a case where the sensor variation and the color filter difference can be compensated for by changing only the charge storage times in view of the relation between the sensor variation and the adjustable range of charge storage times, the LED light intensity may be fixedly set, and thereafter, upon factory assembly, the charge storage times may be set so as to obtain prescribed outputs for respective colors in accordance with results of measurement in which a standard plate is measured using the respective color filters of the sensor.

With this arrangement, it is possible to compensate for a change in light source characteristic caused by a change in electric current flowing through the LED 53, whereby more stable detection can be achieved.

The charge storage sensor forming the light-receiving element 54*a* may be comprised of several juxtaposed sets of three RGB pixels. In the present embodiment, the charged storage sensor is formed by a CMOS sensor, but other charge storage sensor such as a CCD sensor may be used. The sensor may have an incident angle of 0 degree and a reflection angle of 45 degrees. Further, the color sensor 3000 may be comprised of individual RGB LEDs and a charge storage sensor with no filter.

[Color Stabilizing Control for Output Image]

Next, with reference to FIG. 6, an explanation will be given of control for stabilizing colors of an output image, which is carried out in the image forming apparatus of the present embodiment having the aforementioned construction.

Figure 6:
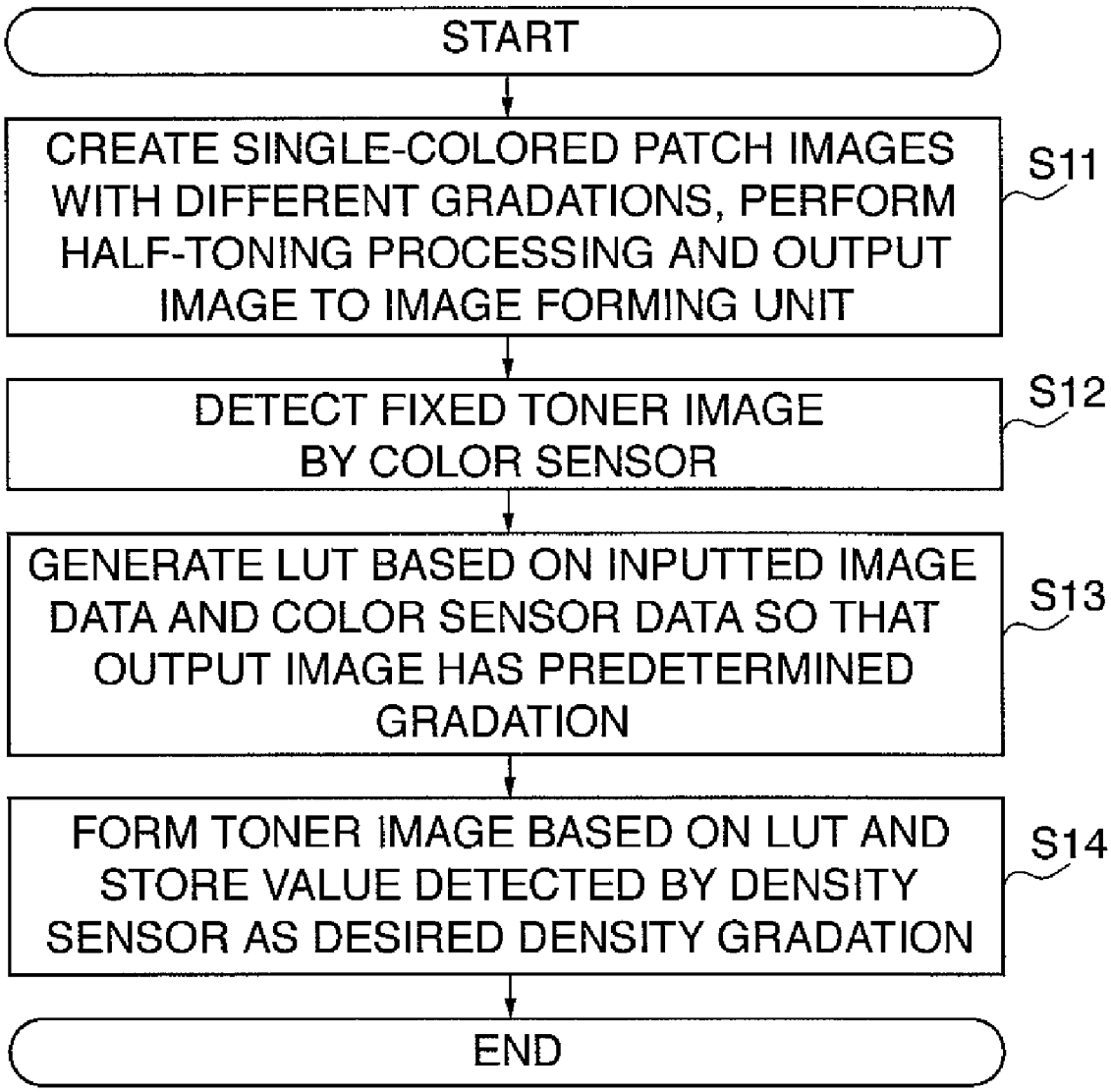
FIG. 6 is a flowchart showing a process for color stabilizing control according to the first embodiment.

FIG. 6 is a flowchart showing the process for color stabilizing control according to the first embodiment.

In the color stabilizing control, the CPU 1033 of the printer controller 1031 produces single-colored toner patch images with different gradations, subjects these images to half-toning processing, and outputs the processed images to the engine unit 1036 (step S11).

In the engine unit 1036, the single-colored toner patch images with different gradations are transferred from the intermediate transfer member 2010 to a transfer material 2027 and fixes the transferred images to the transfer material 2027. Then, the color sensor 3000 reads the fixed toner images (step S12). At this time, the light intensity of the LED 53 and the charge storage times of the light-receiving element 54*a* of the color sensor are set in accordance with the aforementioned settings in which the LED light intensity and the charge storage times vary depending on the toner color of each single-colored toner patch image.

The CPU 1033 causes the density correction table creation unit 1045 to generate an LUT (lookup table) based on the inputted image data before subjected to the half-toning processing and the data detected by the color sensor 3000 so that the output image has a predetermined gradation (step S13). Here, the predetermined gradation indicates an accumulated color difference linear gradation which is described in Japanese Laid-Open Patent Publication (Kokai) No. 2003-324619. The CPU 1033 of the printer controller 1031 registers the LUT in the density correction table storage unit 1050 to convert the gradation of output image into the predetermined gradation (step S14).

[Advantages of the First Embodiment]

In the first embodiment, predetermined toner patch images are formed on a transfer material, and information on density of the predetermined toner patch images formed on the transfer material is detected using the color sensor 3000 disposed along the conveying path on the side downstream of the fixing device. Based on the detected density information, the density correction table is corrected to thereby stabilize color of an output image. At this time, the charge storage times and the light emission intensity in the color sensor 3000 are set based on colors of the predetermined patch images to make it possible to detect the density of an image pattern with a sufficient accuracy irrespective of the color of the image pattern to be detected. As a result, the density of a toner patch image can accurately measured, whereby the accuracy of color stabilizing control for output image can be improved.

Second Embodiment

In the second embodiment, an explanation will be given of an image forming apparatus using color materials (toners) which are the same in hue but are different in density from one another.

In the present embodiment, a six-color image forming apparatus will be described, in which toners of cyan (c), light cyan (lc), magenta (m) and light magenta (lm) are used as the color materials that are the same in hue but different in density from one another, and in addition toners of yellow (y) and black (k) are used. In the following, toners of cyan, magenta, yellow and black will be referred to as the heavy toners, whereas toners of light cyan and light magenta will be referred to as the light toners. It is assumed that the heavy toners have a maximum density of 1.6 and the light toners have a maximum density of 0.65.

In the case of the six-color configuration, a difference in dynamic range of sensor output caused by toner density difference is larger than that caused by toner color difference. As for the difference in dynamic range of sensor output caused by the toner color difference, an explanation has been given in the first embodiment.

Figure 7:
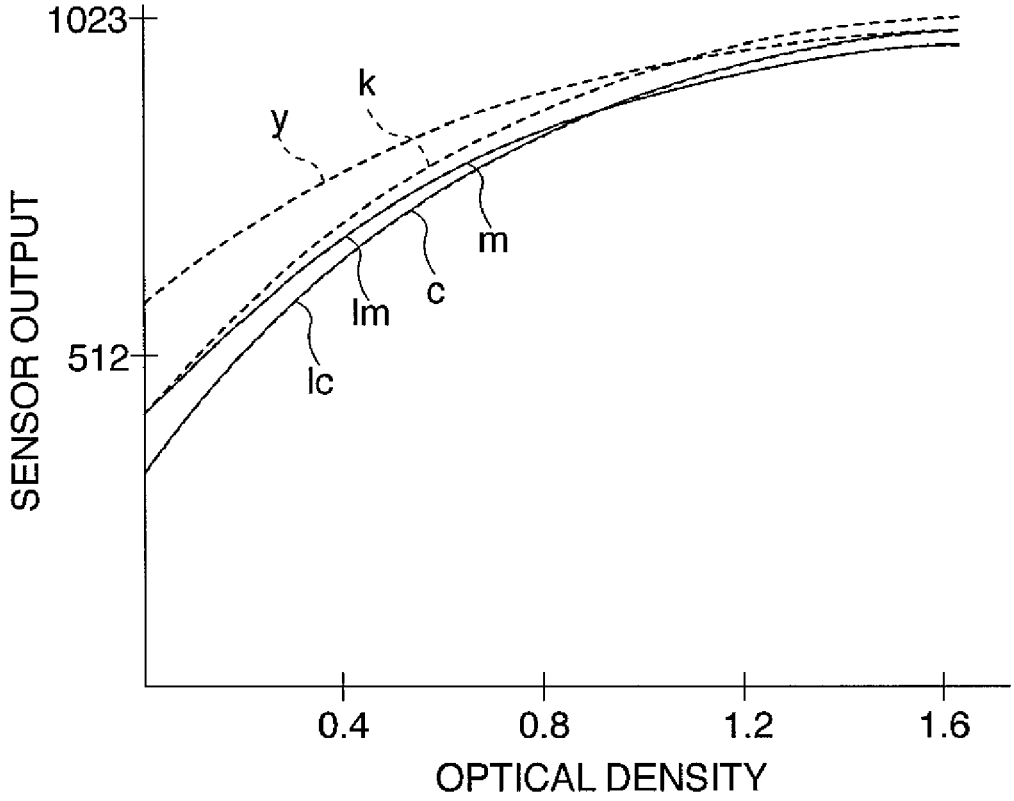
FIG. 7 is a graph showing a sensor output characteristic according to a second embodiment of the present invention.

FIG. 7 is a graph showing a sensor output characteristic in the second embodiment, in which a relationship between density of image pattern and sensor output is shown. Curves y, m, lm, c, lc and k represent sensor output characteristics relative to image pattern density for the respective colors at the same light intensity.

To broaden the dynamic range for light toners, when the maximum intensity is exceeded, the light emission of the LED 53 is lowered so as to decrease the sensor output to zero and then the charge storage time of the light-receiving element 54*a* is increased. The dynamic range is broadened by differentiating the charge storage time for a light toner from that for a corresponding heavy toner. This is because the light emission of the LED 53 has been set in the same manner as in the first embodiment and based on results of measurement of a standard plate, the preset sensor output has been determined to have the same value for both the heavy toner and the light toner.

Figure 8:
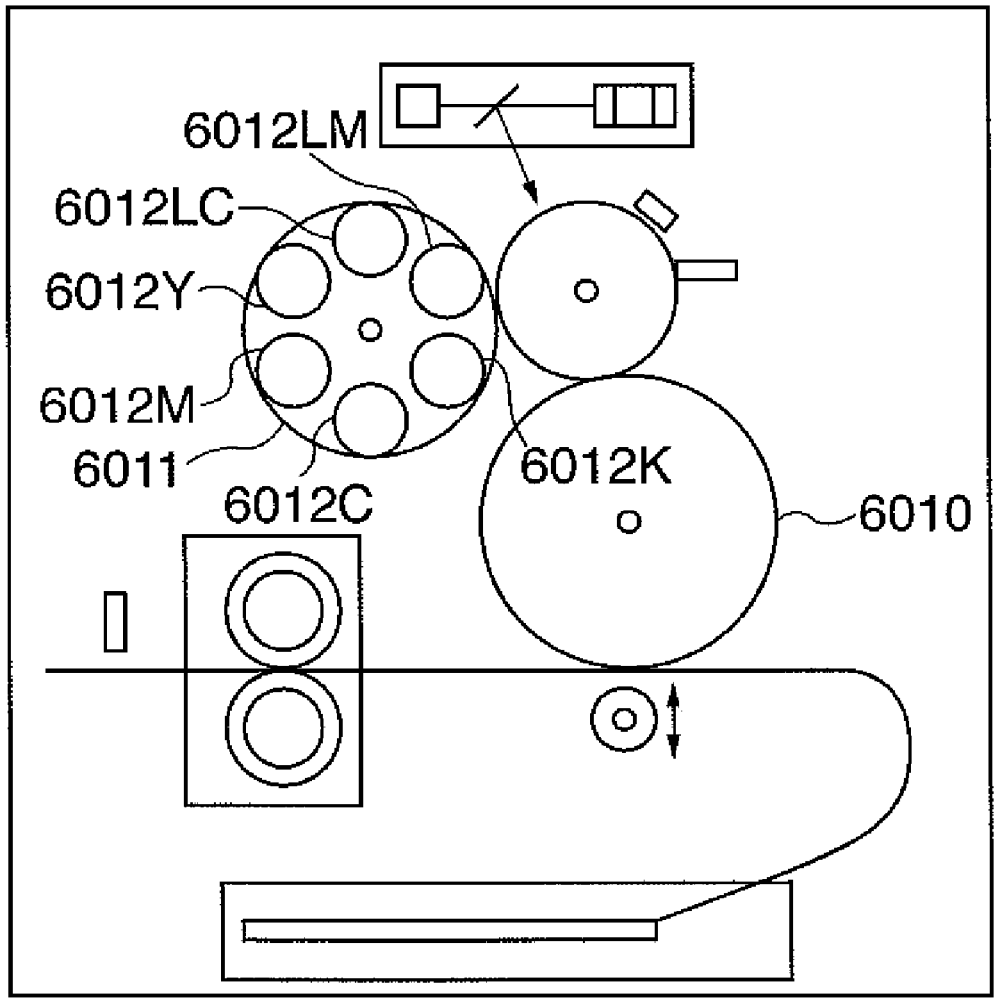
FIG. 8 is a view showing the internal construction of a six-color image forming apparatus.

FIG. 8 is a view showing the internal construction of a six-color image forming apparatus.

The engine unit is comprised of a fixing device, a sheet feeding device, and a conveyance device that are similar to those of the four-color image forming apparatus (four-color machine) and further comprised of an optical processing device which is different in color image forming function from but is similar in monochrome image forming function to that of the four-color machine.

For formation of a six-color image, development process is performed by a light magenta developing device 6012LM, a light cyan developing device 6012LC, a yellow developing device 6012Y, a magenta developing device 6012M, a cyan developing device 6012C, and a black developing device 6012K in the mentioned order while a developing rotary 6011 performs one rotation for each rotation of an intermediate transfer member 6010. During six rotations of the intermediate transfer member 6010, visible images in colors of light magenta, light cyan, yellow, magenta, cyan and black are formed in sequence, whereby a full color visible image is formed on the intermediate transfer member 6010. The construction on the side downstream of the intermediate transfer member 6010 is the same as that of the four-color machine.

The construction of the color sensor 3000 is also the same as that of the four-color machine. The ratio between charge storage times of the light-receiving element 54*a* for the respective colors lm, lc, y, m, c, and k is made equal to 2.2:2:1.5:1.1:1:1.1. As in the first embodiment, the light intensity of LED 53 is adjusted in a condition that the charge storage times have been set for the respective colors. As a result, even in an image forming apparatus using color materials (toners) that are the same in hue but different in density from one another, the toner patch image density can accurately be measured, making it possible to improve the accuracy of color stabilizing control of output image.

Third Embodiment

In the first and second embodiments, the light intensity and the charge storage time of the color sensor 3000 are set for each color material (tone). In the present embodiment, on the other hand, the light intensity and the charge storage time are changed in accordance with the density of each image pattern.

In the first embodiment, the sensitivity of the color sensor 3000 decreases with the increase in density, as shown in FIG. 5. Thus, in the present embodiment, the charge storage time is increased in a high-density zone to thereby increase the sensitivity in the high-density zone.

Figure 9:
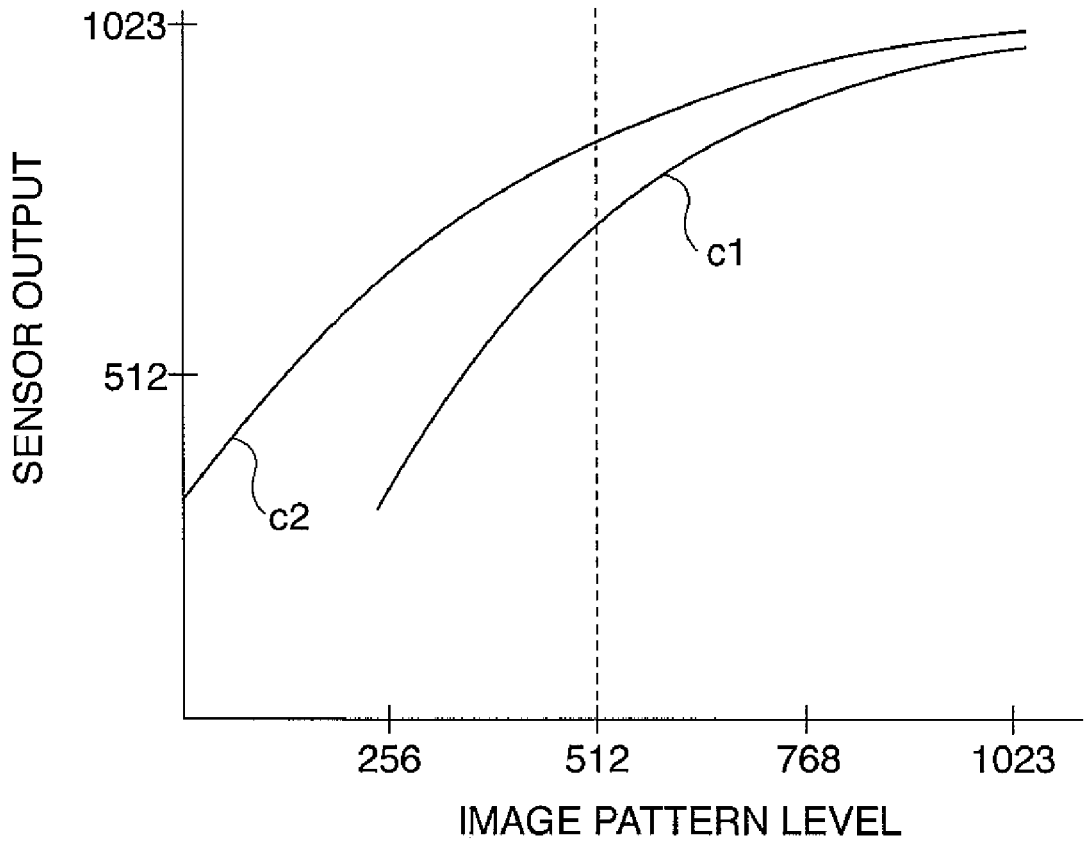
FIG. 9 is a graph showing a sensor output characteristic according to a third embodiment of the present invention.

FIG. 9 is a graph showing a sensor output characteristic according to the third embodiment. More specifically, there are shown curves c1, c2 representative of sensor output values relative to an image pattern density level (10 bits) in the case of using the charge storage times for low-density zone and high-density zone of a cyan image pattern. It should be noted that the charge storage time for high-density zone is made twice as large as that for low-density zone.

To perform the color stabilizing control of output image, image patterns with different gradations are formed, as described in the first embodiment. When a measured portion of the image patterns is at a density level equal to or higher than 512, the charge storage time for the high-density zone is used, whereas the charge storage time for the low-density zone is used when the measured portion of the image pattern is at a density level lower than 512. In a case where the charge storage time for high-density zone is used, the resultant image reading signal is subjected to A/D conversion (10 bits) so as to be converted into RGB digital signals and is then normalized using a normalizing value for high-density zone. The printer controller 1031 converts the normalized signals into density information using a brightness/density conversion table for high-density zone. It should be noted that in the present embodiment a four-color machine is used and the accumulation times are set for respective ones of two density zones for each color, and therefore, there are eight sets of the LED light emission adjusting parameters used for correction of sensor fabrication variation at the time of assembly at a factory, eight sets of the predetermined sensor output normalizing parameters, and eight sets of the brightness/density conversion tables, unlike the first embodiment using four sets of LED light emission adjusting parameters, four sets of sensor output normalizing parameters, and four sets of brightness/density conversion tables.

[Advantages of the Third Embodiment]

According to the present embodiment, the patch density, especially, the patch density in the high-density zone can be measured with accuracy, thereby making it possible to improve the accuracy of color stabilizing control of output image.

It should be noted that in the present embodiment the same image pattern density level at which the accumulation time is changed is used for the respective colors. Alternatively, the accumulation time changing level may be varied in accordance with image pattern color. A plurality of color sensors may be provided, and various preset values may each be set so as to correspond to a corresponding one of combinations of sensors and image patterns to be measured.

Fourth Embodiment

In the present embodiment, an explanation will be given of a method for more accurately measuring the patch density.

In the first and second embodiments, the S/N ratio is improved by broadening the dynamic range of sensor output, to thereby improve the detection accuracy. However, even if the relationship between patch density and sensor output value is determined in advance based on both the sensor output in the standard plate measurement and the sensor output at the maximum density, an actual relationship therebetween is sometimes caused to shift, especially at an intermediate density, from the predetermined relationship. This is caused by a color sensor variation and mainly caused by a variation in spectral distribution of the LED 53.

In the present embodiment, an explanation based on the four-color machine having been described in the first embodiment will be given. An LED 53 in the present embodiment is a white LED that is obtained by adding a fluorescent material into a resin that covers a light emitting part of a blue LED. The spectral characteristic of the LED 53 is shown at symbol (a) in FIG. 10.

The spectral characteristic of this LED 53 has peaks in the regions of blue and red, wherein the peak in the blue region is especially sharp. For this reason, when the spectral distribution characteristic of the LED 53 shifts, due to its variation, to the one shown at symbol (b) in FIG. 1, the sensor output for yellow is caused to vary at an intermediate gradation. In the first embodiment, it has been explained that there is a limit in adjustable range of the light emission of the LED 53. Thus, the fact must be considered that when the light emission of the LED 53 is increased, the spectral characteristic of the LED 53 can vary, resulting in a change in the sensor output characteristic.

Figures 10, 11:
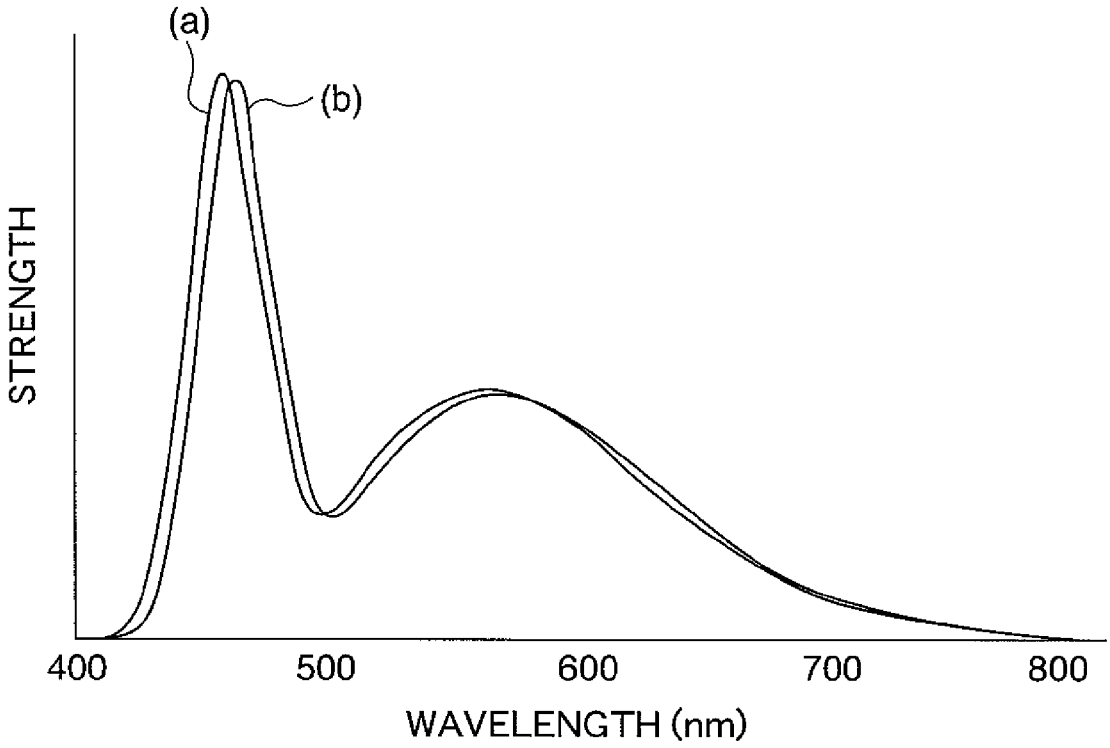
FIG. 10 is a view showing a spectral distribution characteristic of a white LED.
FIG. 11 is a view showing a chromaticity range of the white LED.

In the present embodiment, to suppress a variation in spectral distribution characteristic of the LED 53, LEDs 53 are ranked in terms of chromaticity, so as to selectively use only those LEDs which fall within a chromaticity range shown in FIG. 11, in which the chromaticity range is shown by the CIE XYZ color coordinate system.

In the normalization of RGB signal values performed as described in the first embodiment, an output value at an intermediate density is used in addition to the output indicating the strength of reflection light from a transfer material and the output at maximum density, so as to more accurately correct the sensor output. More specifically, in assembling each individual sensor at a factory, sensor output values at the maximum density of 1.6 and the intermediate density of 0.3 are actually measured and set into the engine control unit. In the color stabilizing control, the sensor output value is normalized so that three points are made equal to preset values, wherein the three points are a sensor output indicating the strength of reflection light from a transfer material and sensor outputs at the maximum density and the intermediate density.

[Advantages of the Fourth Embodiment]

By performing the selection of LEDs in terms of chromaticity rank and the three-point normalization, described in the present embodiment, as well as the settings of light intensity and charge storage times of the sensor, the density value can be measured more accurately to the extent that the patch color can be measured without causing a color difference ΔE larger than 1. As a result, it is possible to improve the accuracy of the color stabilizing control of output image.

In each of the foregoing embodiments, the electrophotographic image forming apparatus has been explained by way of example. However, the present invention is not limited thereto, but is also applicable to various image forming systems including an inkjet image forming apparatus, a sublimation image forming apparatus, and the like.

Further, it is to be understood that the object of the present invention may also be accomplished by supplying a system or an apparatus with a storage medium in which a program code of software, which realizes the functions of any of the above described embodiments is stored, and causing a computer (or CPU or MPU) of the system or apparatus to read out and execute the program code stored in the storage medium.

In this case, the program code itself read from the storage medium realizes the functions of any of the above described embodiments, and therefore the program code and the storage medium in which the program code is stored constitute the present invention.

Examples of the storage medium for supplying the program code include a floppy (registered trademark) disk, a hard disk, a magnetic-optical disk, such as a CD-ROM, a CD-R, a CD-RW, a DVD-ROM, a DVD-RAM, a DVD-RW and a DVD+RW, a magnetic tape, a nonvolatile memory card, and a ROM. Alternatively, the program may be downloaded via a network Further, it is to be understood that the functions of any of the above described embodiments may be accomplished not only by executing the program code read out by a computer, but also by causing an OS (operating system) or the like which operates on the computer to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-098771, filed Mar. 31, 2006, which is hereby incorporated by reference herein in its entirety.

What is claimed is:

1. An image forming apparatus comprising:

a control device for reading a predetermined image pattern formed on an image forming medium using an optical sensor and for controlling image forming conditions based on information on the predetermined image pattern thus read; and a setting device for setting an accumulation time of the optical sensor for reading the predetermined image pattern in accordance with a color, a density, or both a color and a density of the predetermined image pattern, wherein the setting of the accumulation time occurs prior to the optical sensor reading the predetermined image pattern, wherein the accumulation time is a duration of time between a timing of a read-start signal, which starts charge storage for reading the predetermined image pattern, and a timing of a read-stop signal, which completes charge storage for reading the predetermined image pattern, and wherein the setting device further is for setting different accumulation times for reading different predetermined image patterns.

2. The image forming apparatus according to claim 1, wherein the optical sensor is comprised of a light emitting device and a light receiving device, and said setting device sets a light emission of said light emitting device and an accumulation time of said light receiving device in accordance with the color, the density, or both the color and the density of the predetermined image pattern.

3. The image forming apparatus according to claim 1, wherein the predetermined image pattern is formed on the image forming medium using color materials that are the same in hue but different in density from one another.

4. The image forming apparatus according to claim 1, wherein the predetermined image pattern is a gradation pattern, and said control device performs a gradation correcting control using a density correction table.

5. The image forming apparatus according to claim 1, wherein a plurality of said optical sensors are provided, and the accumulation time is set for each of said plurality of said optical sensors.

6. A control method of an image forming apparatus, comprising:

a reading step of reading a predetermined image pattern formed on an image forming medium using an optical sensor;

a controlling step of controlling image forming conditions based on information on the predetermined image pattern having been read in said reading step; and a setting step of setting an accumulation time of the optical sensor for reading the predetermined image pattern in accordance with a color, a density, or both a color and a density of the predetermined image pattern, wherein the setting of the accumulation time occurs prior to the optical sensor reading the predetermined image pattern, wherein the accumulation time is a duration of time between a timing of a read-start signal, which starts charge storage for reading the predetermined image pattern, and a timing of a read-stop signal, which completes charge storage for reading the predetermined image pattern, and wherein the setting step includes setting different accumulation times for reading different predetermined image patterns.

7. The control method of an image forming apparatus according to claim 6, wherein the optical sensor used in said reading step is comprised of a light emitting device and a light receiving device, and in said setting step, light emission of the light emitting device and the accumulation time of the light receiving element are set in accordance with the color, the density, or both the color and the density of the predetermined image pattern.

* * * * *